United States Patent [19]

Wilford

[11] 4,325,317

[45] Apr. 20, 1982

[54] AIRCRAFT CARRIER

[76] Inventor: E. Burke Wilford, 840 Montgomery Ave., Bryn Mawr, Pa. 19010

[21] Appl. No.: 92,353

[22] Filed: Nov. 8, 1979

[51] Int. Cl.[3] ..... B63B 35/035

[52] U.S. Cl. ..... 114/261; 244/63; 244/114 R

[58] Field of Search ..... 114/261, 262, 72, 85, 114/339, 342, 91, 126, 258; 244/63, 114 R, 116

[56] References Cited

U.S. PATENT DOCUMENTS

| | | | |
|---|---|---|---|
| 1,287,737 | 12/1918 | Ortiz | 114/262 |
| 1,292,097 | 1/1919 | Schweinert | 114/262 |
| 1,296,689 | 3/1919 | Noah | 114/339 |
| 1,847,549 | 3/1932 | Adams | 114/261 X |
| 2,526,541 | 10/1950 | Colley | 244/114 R X |
| 3,000,343 | 9/1961 | Winter | 114/261 |
| 3,066,634 | 12/1962 | Suberkrub | 114/126 |
| 3,785,316 | 1/1974 | Leming et al. | 114/261 |

OTHER PUBLICATIONS

*Cargo Warship General Arrangement Plans,* The Motor Ship, Jun. 1943, vol. XXIV, No. 281, pp. 97–98, London Temple Press Ltd., Bowling Green Lake, London, 13C1.

*Primary Examiner*—Robert B. Reeves
*Assistant Examiner*—Douglas D. Watts
*Attorney, Agent, or Firm*—Dann, Dorfman, Herrell & Skillman

[57] ABSTRACT

An aircraft carrier, the main deck of which is provided with an armored enclosure housing at least one work area for servicing aircraft. Service bays are arranged sequentially in the work area within the hangar in assembly-line fashion. Takeoff assisting means for the aircraft is provided on a portion of the main deck. The work areas can be divided by fire and explosion resistant doors which open and close with each refurbishing phase started or completed, with major increase in the speed of squadron operation.

14 Claims, 13 Drawing Figures

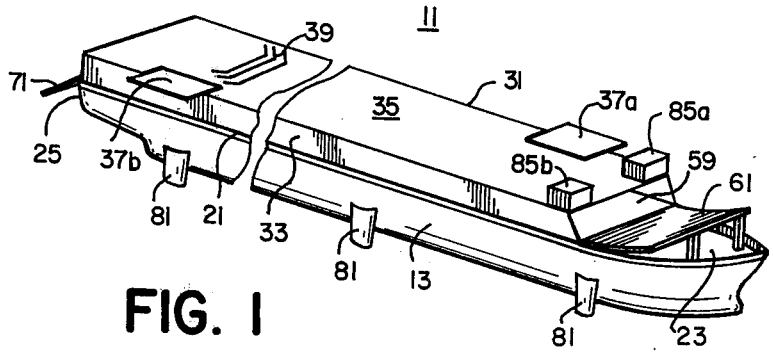
FIG. 1
FIG. 2
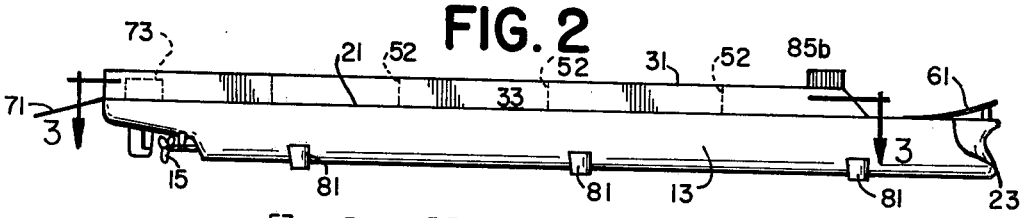
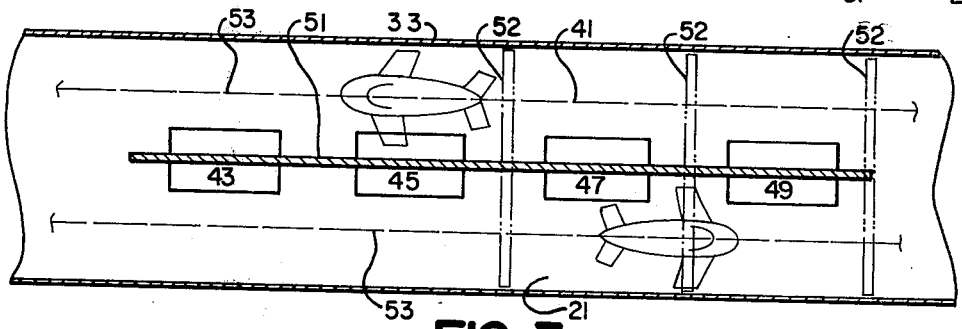
FIG. 3
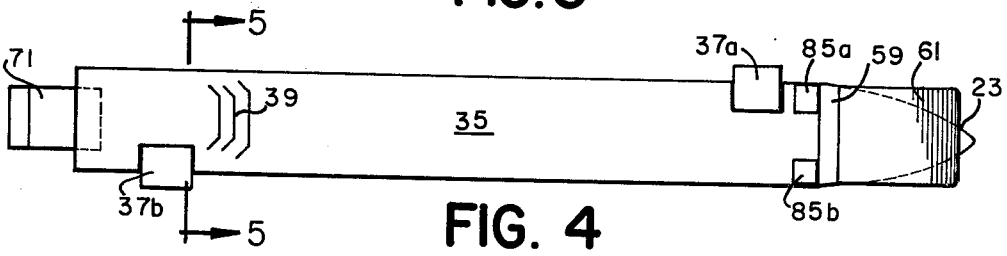
FIG. 4
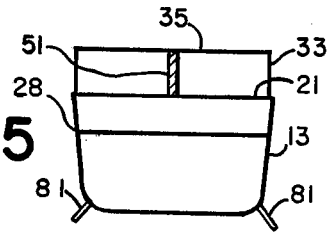
FIG.5

AIRCRAFT CARRIER

The present invention relates to aircraft carriers, and more particularly to an aircraft carrier structure adapted to accommodate the new generation of military aircraft.

There have been no major modifications in the basic structure of aircraft carriers in recent years. However, there have been tremendous advances in the design and capabilities of military aircraft, with the emphasis being on the development of short take-off and landing (STOL) and vertical take-off and landing (VTOL) aircraft. In view of the capabilities of the newer aircraft, flight decks of 900 feet or more, as are found on present day aircraft carriers, are no longer a necessity. Accordingly, the flight deck could be more efficiently utilized to fill other operational needs of the aircraft. This is particularly true at present, when the number of United States air bases around the world continues to shrink. In the years to come, aircraft carriers must be designed with the capacity for carrying out the functions formerly accomplished by land bases. Thus, aircraft carriers of the future should be constructed with the capability of servicing and housing several squadrons of aircraft in an efficient and effective manner. Presently, routine servicing of aircraft is carried out on the flight deck of the aircraft carrier and requires maintenance crews to carry servicing equipment, fuel, and armaments to each individual aircraft to be serviced. This servicing procedure is not only inefficient, but involves serious risk of injury to maintenance personnel and damage to the aircraft, especially during time of war, due to the proximity of highly flammable jet fuel and aircraft armaments.

Accordingly, it is an object of the present invention to provide an aircraft carrier structure particularly adapted to the operation of STOL and VTOL aircraft.

A further object of the present invention is to provide an aircraft carrier constructed to permit substantially simultaneous take-off and landing of aircraft.

Another object of the present invention is to provide an aircraft carrier having a work area with protected and segregated aircraft service bays.

It is also an object of the present invention to provide an aircraft carrier having service bays so arranged as to effectively and efficiently service aircraft.

Yet another object of the present invention is to provide an aircraft carrier capable of deploying and servicing two squadrons of aircraft at the same time and servicing the aircraft in separate assembly lines for refueling, rearming and changing personnel in a protected work area.

The foregoing objects have been achieved by modifying the conventional superstructure of aircraft carriers to provide the main deck thereof with an armored enclosure, or hangar which houses at least two service bays for the aircraft. The service bays are arranged within the hangar in assembly-line fashion in a predetermined sequence, and may be disposed so as to service at least two lines of aircraft passing through the armored hangar simultaneously. The vessel may also house aircraft which is not in service. Although the aircraft carrier of the present invention can accommodate all types of aircraft, it is particularly adapted to the operation of STOL an VTOL aircraft. To this end, the upper surface of the armored hangar is provided with a take-off and landing area which is with a take-off and landing area which is considerably shorter than the flight deck of conventional aircraft carriers. Also, the bow portion of the vessel is provided with take-off assisting means for the aircraft, both catipults and ski jumps or a combination of both.

The aircraft carrier of the present invention will be described more fully hereinafter with reference to the accompanying drawings, wherein:

FIG. 1 is a foreshortened perspective view of one embodiment of the aircraft carrier of the present invention with a portion of the amidships omitted;

FIG. 2 is a side elevation of the aircraft carrier shown in FIG. 1;

FIG. 3 is a horizontal partial cross-sectional view taken along the line 3—3 of FIG. 2 showing the arrangement of the service bays.

FIG. 4 is a plan view showing the superstructure of the aircraft carrier of FIG. 1;

FIG. 5 is an outline of a sectional view taken along the line 5—5 of FIG. 4;

Figure 6:
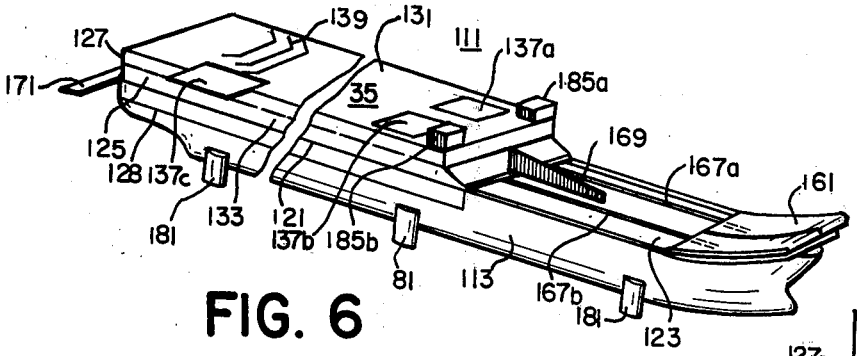
FIG. 6 is a foreshortened perspective view similar to FIG. 1 of another embodiment of the aircraft carrier of the present invention.
Figure 13:
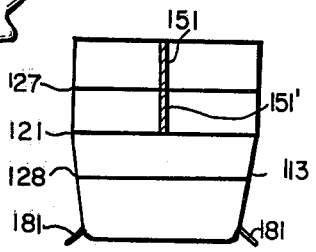
FIG. 13 is an outline of a sectional view taken along the line 13—13 of FIG. 10.

Referring now more specifically to the embodiment shown in FIGS. 1-5, the principal structural components of the aircraft carrier 11 of the present invention are a hull 13, propulsion means 15 for propelling the hull through a body of water, main deck 21, and hangar 31. As shown in FIGS. 1-4, hangar 31 encloses a major portion of the main deck 21 including the stern 25, the amidships, and a portion of the bow 23. The area of enclosure may be between about 50 to 80 percent of the total area of the main deck. Hangar 31 houses one or more work areas for the aircraft and is composed of armored sidewalls 33 and an armored roof member 35 supported by sidewalls 33. Armored roof member 35 is disposed substantially parallel to main deck 21 and is flat and unobstructed, thus providing a takeoff and landing area for the aircraft. Elevator means **37*a* and 37*b* transfer aircraft between the takeoff and landing area on roof member 35 and the work area(s) enclosed by hangar 31. A portion of main deck 21, preferably bow portion 23, serves as a takeoff area for the aircraft and is provided with takeoff assisting means for various types of aircraft, which may be, for example, an upwardly-sloping travelway 61, which resembles a ski jump, and is centrally positioned on the bow. When the hangar encloses more than about 60 percent of main deck 21**, the aircraft must begin their take-off run inside the hangar. Accordingly, provision must be made for directing the jet blast outside of the hangar to avoid damage to equipment and the interior of the hangar itself.

As illustrated in FIG. 3, work area 41 of the carrier 11 comprises service bays 43, 45, 47 and 49 arranged in a predetermined sequence in assembly-line fashion. By servicing the aircraft in this manner, only one servicing operation is performed on an aircraft at any given time, and each aircraft system being serviced is secured before the aircraft proceeds to the next service bay, thus reducing the chance of accidential injury to personnel or damage to aircraft. The aircraft are transferred in columns from one service bay to the next by suitable aircraft conveyor means 53, as illustrated diagrammatically in FIG. 3. The direction of the columns of aircraft may be regulated for movement of the columns in the same direction, or in opposite directions as shown in FIG. 3.

For the most part, the hull and propulsion means of aircraft carrier are conventional. For example, the propulsion means may comprise either an atomic or a petroleum-fired turbine power plant. However, a non-conventional feature is included in the hull structure in order to control the rolling of the vessel in rough seas. More specifically, the hull 13 may be provided with a plurality of stabilizing fins 81, as shown in FIGS. 1, 2 and 5 which are operatively associated with means mounted on hull 13 for projection into the water and retraction into the outline of the hull. Stabilizing fins of this type are sometimes used on smaller vessels and are well known to those skilled in the art. It is believed that such stabilizing means have never been used on a vessel as large as an aircraft carrier. A multiple number of these fins, arranged properly along the hull, will reduce stresses on the hull.

A portion of main deck 21, preferably the stern portion 25, is provided with at least one ramp 71, as shown most clearly in FIGS. 2 and 4 extending outwardly and downwardly to the surface of the water, or below. Amphibious craft of various types may be retrieved from the water by traversing the ramp onto the stern portion of the aircraft carrier. To facilitate retrieval recovery means, such as, derrick 73 in FIG. 2, may be provided on the stern portion of the main deck for hoisting the craft onto the main deck. The ramp and derick may also be used for the recovery of disabled aircraft.

VTOL aircraft returning for service to the aircraft carrier illustrated in FIGS. 1–5 will preferably land at the stern of the vessel. After landing, the aircraft enter elevator 37*b*, and descend to work area 41 within hangar 31. The aircraft progress through work area 41 in the stern-to-bow direction, and, upon completion of sevicing, exit through hangar door 59 and are then in position for take-off from bow portion 23, where travelway 61 is located to assist the take-off. Upwardly sloping travelway 61 is particularly suited to assist the take-off of deflected slip stream aircraft, commonly referred to as B-type VOLTS.

STOL aircraft will preferably approach the aircraft carrier of FIGS. 1–5 and land in the stern-to-bow direction, descend to work area 41 on elevator 37*a*, proceed through the service bays in a bow-to-stern direction, ascend to the take-off and landing area on the upper surface of hangar roof member 35 by way of elevator 37*b* and take-off in a stern-to-bow direction.

It can thus be seen that simultaneous take-offs and landings are possible with the aircraft carrier of the present invention since V/STOL aircraft or catipultible conventional fighters like F-14 & 18 can land on the upper surface of hangar roof member 35 without interfering in any way with the take-off of VTOL craft from the take-off area on the bow portion 23 of main deck 21.

When the aircraft descend to main deck 21 for servicing conveyor means 53 engage each aircraft for conveying the aircraft through work area 41. As can be seen in FIG. 3, work area 41 includes service bays preferably disposed along the longitudinal center line of main deck 21, and conveyor means 53 comprises runs disposed, approximately equidistant from the center line of the main deck and the hull, on either side of work area 41. In order to insure against fire disabling both conveyor means, longitudinal fireproof barrier 51 is provided for isolating one run from the other. Barrier 51 also provides added support for hangar roof member 35. In a preferred embodiment of the invention, conveyor means 53 is mounted in the main deck and comprises endless chains having hooks attached thereto which cooperate with means provided on the underside of the aircraft whereby the aircraft are, in effect, towed from one service bay to the next. The chain mountings are provided with an appropriate mechanism, e.g., sprocket wheels operatively associated with a heavy-duty motor, for advancing the chain.

As previously mentioned, the work area comprises bays arranged in assembly-line fashion. Although the number of service bays may vary, the work area should include as a minimum, a personnel change bay 43, an electronic systems maintenance bay 45, a refueling bay 47, and a rearming bay 49, for each column of aircraft, preferably arranged in the stated order. Of course, other servicing bays, such as an engine maintanence bay and a wheel-and-landing gear maintenance bay may also be included in the line. The refueling bay 47 and rearming bay 49 may be isolated from one another, as well as from the remainder of the service bays by fire doors 52 which may operate in the manner of an overhead garage door.

Figure 7:
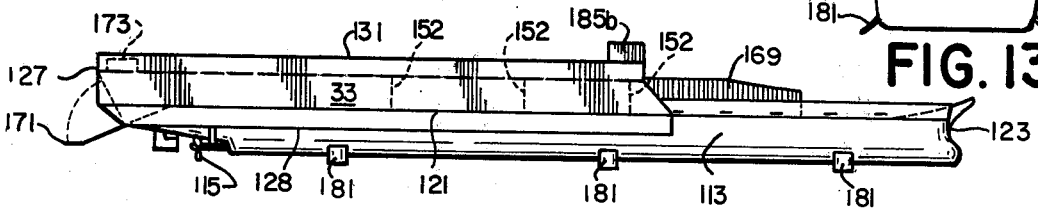
FIG. 7 is a side elevation of the aircraft carrier shown in FIG. 6.

The aircraft carrier 111 illustrated in FIGS. 6–13, like the embodiment described above, comprises a hull 113, propulsion means 115, and a main deck 121, a major portion of which is enclosed by hangar 131. In this embodiment also, the armored sidewalls 133 of the hangar 131 support an armored roof member 135 which serves as a takeoff and landing area for the aircraft. As can be seen most clearly in FIGS. 6 and 10, a greater portion of the bow 123 is exposed in this embodiment than in the embodiment shown in FIGS. 1–5. This construction allows for the deployment of other takeoff assisting means on the bow 123, such as catapults 167*a* and 167*b* shown schematically in FIGS. 6, 8, 9 and 10, in addition to travelway 161. This embodiment may also be provided with a ramp 171 and recovery means 173, as shown in FIG. 7, for retrieval of amphibious craft.

Figure 11:
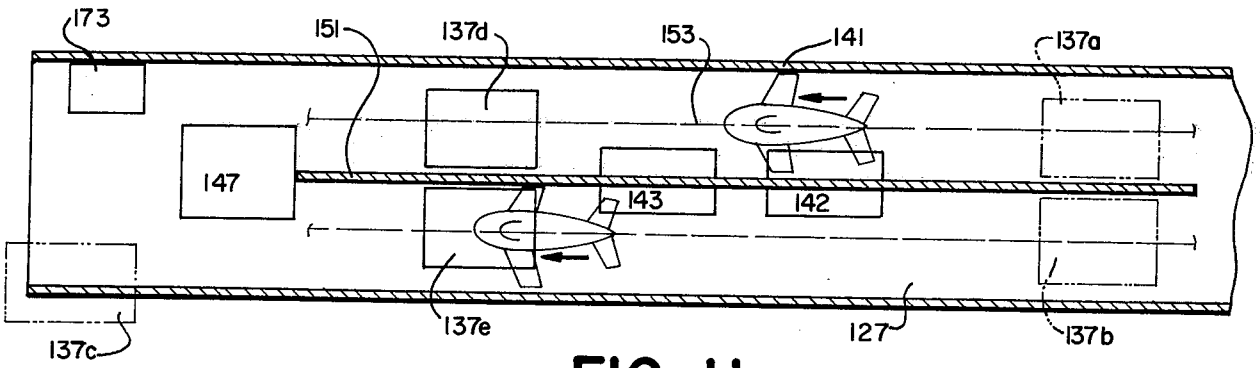
FIG. 11 is a horizontal partial cross-sectional view of the auxiliary or hangar deck of the aircraft carrier of FIG. 6.

In this embodiment, an auxiliary or hangar deck 127 is disposed between the main deck 121 and the hangar roof 135. Hangar deck 127, as shown in FIG. 11, is provided with a work area 141 comprising stations 142 and 143 where the aircraft undergo inspection and minor repairs. Elevator means 137*a*, 137*b* and 137*c* transfer aircraft between the takeoff and landing area on hangar roof 135 and hangar deck 127. Elevator means 137*d* and 137*e*, shown in FIGS. 11 and 12, transfer aircraft between hangar deck 127 and work area 144 on main deck 121 for refueling at service bay 145 and rearming at service bay 146. In this embodiment, the aircraft are transferred from one station to the next on hangar deck 127 and from one service bay to the next on main deck 121 by conveyor means 153,153' which operates in the same manner as conveyor means 53 described above. In this embodiment also the conveyor means of the hangar deck and main deck are separated by a fireproof barrier 151, and the refueling and rearming areas are isolated by fire doors 152, which are the same as doors 52 described above. In the event that an aircraft requires more extensive repairs, necessitating its removal from the conveyor, such repairs may be performed in service bay 147, shown in FIG. 11, and service bay 148, shown in FIG. 12, both of which are located in the stern portion of the vessel, on the sternside of elevators 137*d* and 137*e*.

STOL aircraft returning for servicing to the aircraft carrier illustrated in FIGS. 6–13 will preferably approach the aircraft carrier for landing in the stern-to-bow direction and upon landing descend on elevators 137*a* and 137*b* to hangar deck 127 where the aircraft move in a bow-to-stern direction for inspection, systems checks, and minor repairs, if necessary. Thereafter, the aircraft are transferred on elevators 137*d* and 137*e* to main deck 121 where the aircraft progress through work area 144 in the stern-to-bow direction for refueling and rearming. Upon completion of servicing on main deck 121, the aircraft exit through hangar door 159 and are in position for takeoff from bow portion 123.

VTOL aircraft, such as helicopters and V/STOL aircraft, for example, may land near the stern, descend on elevator 137*c* to hangar deck 127 for minor servicing and return to hangar roof member 135 via elevator 137*c* for take-off. In such case a refueling station should be provided near elevator 137*c*. Alternatively, the aircraft may continue on to main deck 121, pass through work area 144, and exit hangar 131 onto bow portion 123 for take-off.

The aircraft carrier of the present invention also makes possible expeditious and efficient use of aircraft having the combination of characteristics of vertical or very slow take-off and landing capabilities as well as the capability of cruising at a maximum lift over drag relationship. Such aircraft, commonly known as Convertiplanes, may preferably approach the aircraft carrier for landing according to any of the patterns described above, and thus allow operations to make use of the elevators near the bow or the elevator near the stern of the vessel.

Figure 10:
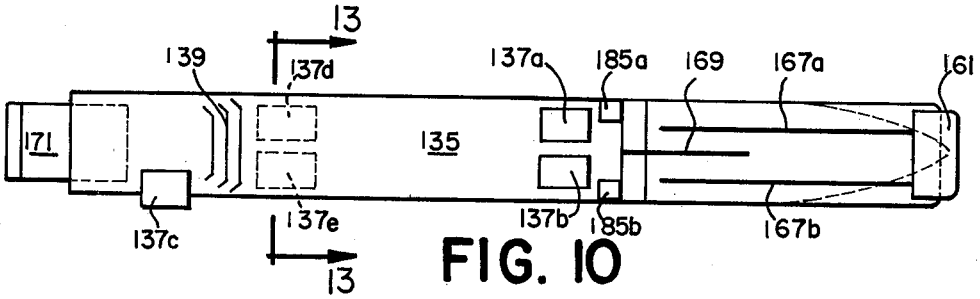
FIG. 10 is a plan view showing the superstructure of the aircraft carrier of FIG. 6.

The aircraft carrier of the present invention may also accommodate conventional aircraft. To this end, the takeoff and landing area on the hangar roof is provided with aircraft arresting means 39, as shown in FIGS. 1 and 4, and arresting means 139, as shown in FIGS. 6 and 10, which cooperates with means provided on the aircraft for slowing the speed of the landing aircraft. An example of the aforementioned arresting means is the conventional series of steel cables wound onto tension drums, as currently found on aircraft carrier flight decks, which cables engage an arresting hook provided on the underside of the aircraft fuselage upon landing. It should be understood that while conventional aircraft may land on the hangar roof member, only V/STOL aircraft may take off from there.

As shown in FIGS. 6 and 10, the take-off assisting means may include catapults 167*a* and 167*b*, as well as travelway 161. The catapults, which assist aircraft thus requires additional thrust for take-off, may comprise a runway track for guiding the aircraft, which is thrust forward as a cable which engages an appendage on the aircraft is wound onto a turbine-driven take-up reel. An example of such a catapult is disclosed in U.S. Pat. No. 3,220,216. Alternatively, the aircraft may be launched by a steam catapult, such as that disclosed in U.S. Pat. No. 3,504,872. When catapults are employed in parallel, as shown in FIGS. 6 and 10, a jet-blast deflector 169 is interposed between them to facilitate simultaneous operation thereof. It should be noted that the landing of STOL aircraft on the hangar roof 135 will not interfere with the catapulting of aircraft from the take-off area on the bow.

Figure 8:
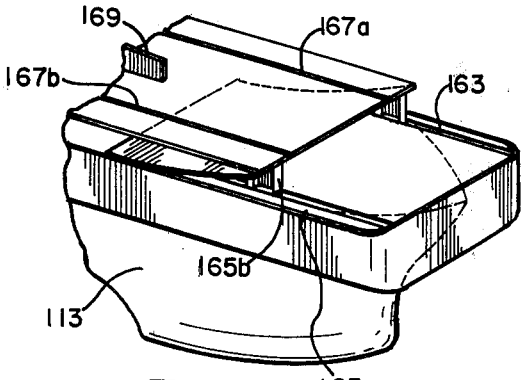
FIG. 8 is a fragmentary perspective view of the bow portion of the vessel of FIG. 6 showing take-off assisting means for the aircraft in a retracted position.
Figure 9:
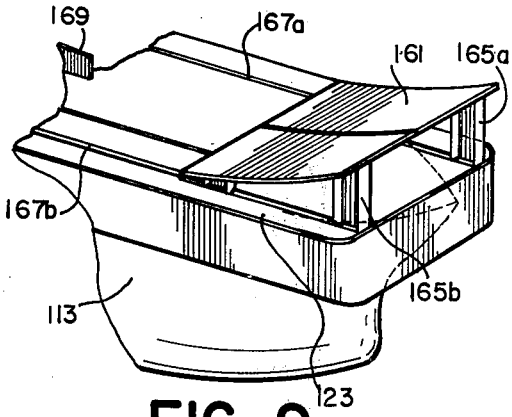
FIG. 9 is a fragmentary perspective view of the bow portion of the vessel of FIG. 6 showing take-off assisting means for the aircraft in a fully extended position.

The travelway 161, as shown in FIGS. 8 and 9, may be actuatable between a retracted position, shown in dotted lines in FIG. 8, in which it is disposed within the plan view outline of the hull, and an extended position, as shown in FIG. 9, in which it extends beyond the outline of the hull and slopes upwardly in the stern-to-bow direction. The travelway, which in this arrangement is movably mounted on a track 163, is operable in at least one position between the retracted and fully extended position, thereby allowing for variation in the length of the runway. Alternatively, travelway 161 may be permanently deployed in an extended position, like that shown in FIG. 9, with the rear edge of the travelway pivotally connected to the main deck so that the travelway will be flush with the main deck, more or less, when in the retracted position. In either case, the travelway must be so constructed to permit unobstructed use of the catapults 167*a* and 167*b*.

In order to vary the slope of the travelway relative to the main deck, means such as hydraulic lifters 165*a*, 165*b* are operatively associated with travelway 161 and serve to raise or lower the leading edge thereof. The slope of the travelway 161 relative to the main deck 121 should be variable to allow for adjustment in accordance with the load factor of the landing gear of various types of aircraft and, as noted above, so as not to interfere with the operation of the catapults. The travelway may be divided into two portions approximately along the longitudinal center line, as shown in FIGS. 6, 8, and 9, with the slope of each portion being independently variable, by means of hydraulic lifters 165*a* and 165*b*.

Figure 12:
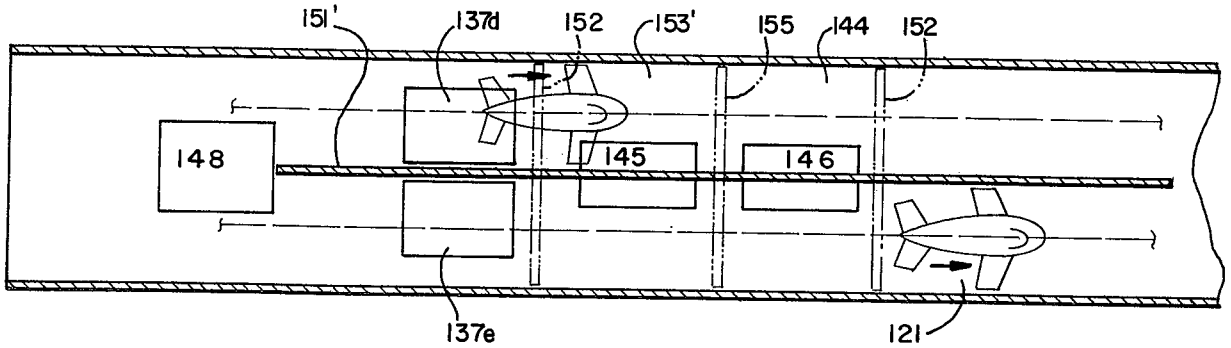
FIG. 12 is a horizontal partial cross-sectional view of the main deck of the aircraft carrier of FIG. 6.

Elevator means 137*a*, 137*b*, 137*d* and 137*e* shown in FIGS. 10–12, may operate in conventional fashion or may take the form of turntables mounted on shafts which rotate as they ascend and descend. The advantage of such turntables is that they can orient the aircraft in the proper position for conveyance through the work area(s).

In accordance with another aspect of the present invention, a storage deck 28 in the aircraft carrier of FIGS. 1 and 2, and 128 in FIGS. 6 and 7, may be disposed below the main deck. Aircraft not in service remain on the storage deck. Of course, when the vessel is constructed with a storage deck, additional elevator means will be required for efficient movement of aircraft between the storage deck and main deck.

Instead of the bridge which is ordinarily found on present day aircraft carriers, the aircraft carrier of the present invention has at least one conning tower located on the periphery of the hangar roof. In a preferred embodiment of the invention, the aircraft is provided with two conning towers 85*a* and 85*b* as shown in FIGS. 1, 2 and 4, or towers 185*a* and 185*b*, as shown in FIGS. 6, 7 and 10, one located in each corner of the forward end of the hangar roof. These conning towers have a low silhouette so as to conform with the overall low profile of the vessel. The conning towers may be provided with elevating means so that they may be elevated to give command personnel a better vantage point from which to oversee take-off and landing operations. This will also be useful in docking or refueling operations. The aircraft carrier is also provided with communication means in the conning tower 85*a*, 85*b*, 185*a* or 185*b* having a low silhouette during periods of non-use, and which may be elevated when in operation.

With regard to the overall dimensions of the aircraft carrier of the present invention, the vessel is preferably about 970 feet in length with a beam of about 100 feet and a draft of about 30 feet. Approximately 22 feet of clearance is provided between decks. Travelway 61 is approximately 250 long and about 80 feet wide. The takeoff and landing area atop hangar roof member 35 is approximately 600 feet long and 100 feet wide. The dimensions of the aircraft carrier of the present invention are such that it can easily pass through the Panama Canal, and thus respond relatively quickly to crises in either the Atlantic or Pacific Oceans.

The sidewalls of hangar 31 are preferably composed of armored plate having a thickness of about one inch and roof member 35 is preferably composed of armored plate having a thickness of about two inches. The conning towers are approximately 15 feet on each side and may be elevated to a height of about 25 feet above the armored roof member.

Although a particular embodiment of the present invention has been illustrated and described herein, it is not intended to limit the invention to such disclosure, but changes and/or additions may be made therein and thereto without departing from the invention as set forth in the following claims.

I claim:

1. An aircraft carrier comprising a hull having propulsion means to propel said hull through a body of water, a main deck having service bays for aircraft disposed thereon, said main deck comprising a bow portion, and a stern portion, a hangar covering at least one of said portions, said hangar enclosing a work area occupying about 50 to 75 percent of the total area of said main deck, said work area including said service bays, said hangar comprising armored spaced-apart sidewalls, an armored roof member supported by said sidewalls and disposed substantially parallel to said main deck, said service bays being arranged in a predetermined sequence in assembly-line fashion, the upper surface of said roof member having a flat portion providing a takeoff and landing area for said aircraft, and elevator means between said upper roof surface and said main deck for transporting said aircraft therebetween; take-off assisting means for said aircraft disposed on said bow portion; said stern portion being provided with at least one ramp extending outwardly and downwardly therefrom, said ramp being adapted to be disposed at or below the surface of said body of water, whereby amphibious craft may traverse said ramp into said stern portion.

2. The aircraft carrier defined in claim 1 wherein said take-off assisting means comprises a travelway actuatable between a retracted position wherein said travelway is disposed within the outline of said hull and at least one extended position wherein said travelway extends beyond the outline of said hull, sloping upwardly in the stern-to-bow direction.

3. The aircraft carrier defined in claim 2 wherein said travelway has operatively associated therewith means for varying the slope thereof relative to said main deck.

4. The aircraft carrier defined in claim 2 wherein a second take-off assisting means is disposed on said take-off area of said main deck, said second take-off assisting means comprising at least one catapult.

5. The aircraft carrier defined in claim 1 wherein said service bays are disposed along the longitudinal center line of said main deck, said main deck having conveyor means comprising runs on either side of said service bays for conveying the craft to be serviced past said service bays.

6. The aircraft carrier defined in claim 5 wherein the service bays comprise:

a. a personnel change bay;

b. an electronic systems maintenance bay;

c. a refueling bay; and d. a rearming bay.

7. The aircraft carrier defined in claim 6 wherein the personnel change bay is arranged first in said predetermined sequence, followed by the electronic systems maintenance bay, said electronic systems maintenance bay being followed by the refueling bay, the final servicing bay in said sequence being the rearming bay.

8. The aircraft carrier defined in claim 1 wherein said take-off and landing area is provided with arresting means adapted to cooperate with said aircraft for slowing the speed of said aircraft upon landing.

9. The aircraft carrier defined in claim 1 including a plurality of stabilizing fins and means mounting said fins on said hull for projection into said body of water and retraction into the outline of said hull.

10. The aircraft carrier defined in claim 1 additionally comprising an auxiliary deck located between said main deck and said armored roof member and having at least one service area disposed thereon, first elevator means between said hangar roof and said auxiliary deck and second elevator means between said auxiliary deck and said main deck for transporting aircraft between said decks.

11. The aircraft carrier defined in claim 10 wherein the service areas on the hangar deck comprise:

a personnel change area; and an electronic systems maintenance area;

and the service bays on the main deck comprise:

a refueling bay; and a rearming bay.

12. The aircraft carrier defined in claim 1 wherein at least one conning tower is disposed on the periphery of said armored roof member and means are provided for elevating said conning tower relative to the surface of said roof member.

13. The aircraft carrier defined in claim 1 additionally comprising communication means and means for elevating said communication means when in operation.

14. An aircraft carrier comprising a hull having propulsion means to propel said hull through a body of water, a main deck having a portion providing a takeoff area for aircraft, said main deck providing a work area for servicing aircraft, a hangar housing said work area, said hangar comprising armored spaced apart sidewalls and an armored roof member supported by said sidewalls, and take-off assisting means disposed on said take-off area of said main deck comprising a travelway actuatable between a retracted position wherein said travelway is disposed within the outline of said hull and at least one extended position wherein said travelway extends beyond the outline of the hull, sloping upwardly in the stern-to-bow direction, the travelway being divided into portions approximately along the longitudinal center line of said travelway and having means to vary the slope of each portion independently relative to the main deck.

* * * * *